US009587464B2

(12) United States Patent
Jani

(10) Patent No.: US 9,587,464 B2
(45) Date of Patent: Mar. 7, 2017

(54) MULTI-STAGE LINER WITH CLUSTER VALVES AND METHOD OF USE

(71) Applicant: STAGE COMPLETIONS INC., Calgary (CA)

(72) Inventor: William Jani, Calgary (CA)

(73) Assignee: SC ASSET CORPORATION, Calgary, Alberta ( * ) Notice: Subject to any disclaimer, the term of this patent is extended or adjusted under 35 U.S.C. 154(b) by 272 days.

(21) Appl. No.: 14/505,384

(22) Filed: Oct. 2, 2014

(65) Prior Publication Data

US 2016/0097257 A1 Apr. 7, 2016

(51) Int. Cl.

| | |
|---|---|
| ***E21B 34/14*** | (2006.01) |
| ***E21B 33/14*** | (2006.01) |
| ***E21B 34/06*** | (2006.01) |
| ***E21B 43/26*** | (2006.01) |
| *E21B 34/00* | (2006.01) |

(52) U.S. Cl.

CPC ..... *E21B 34/14* (2013.01); *E21B 33/146* (2013.01); *E21B 34/063* (2013.01); *E21B 43/26* (2013.01); *E21B 2034/007* (2013.01)

(58) Field of Classification Search

CPC ..... E21B 34/14; E21B 2034/007

See application file for complete search history.

(56) References Cited

U.S. PATENT DOCUMENTS

| | | | | |
|---|---|---|---|---|
| 2011/0240301 | A1 | 10/2011 | Robison et al. | |
| 2013/0068484 | A1 | 3/2013 | Themig et al. | |
| 2013/0312965 | A1* | 11/2013 | Themig | E21B 34/14 166/285 |

FOREIGN PATENT DOCUMENTS

| | | | |
|---|---|---|---|
| CA | 2842568 | A1 | 5/2014 |
| WO | 2010096309 | A1 | 8/2010 |
| WO | 2011134069 | | 11/2011 |

OTHER PUBLICATIONS

International Searching Authority—Canadian Intellectual Property Office, International Search Report and Written Opinion, mailed Jun. 16, 2015—International Application No. PCT/CA2014/050960, filed Oct. 3, 2014.

* cited by examiner

*Primary Examiner* — Robert E Fuller
(74) *Attorney, Agent, or Firm* — Gowling WLG (Canada) LLP; D. Doak Horne

(57) ABSTRACT

A multi stage liner with cluster valves for completing and performing multiple fracture stimulations along a length of wellbore. Groups of cluster valves, with isolation between such groups of cluster valves, and a method of using same, are provided to achieve increased oil and gas flow to a wellbore in openhole or cased hole applications for oil and gas wells.

15 Claims, 6 Drawing Sheets

47
46

46
47

63
47
46
63

MULTI-STAGE LINER WITH CLUSTER VALVES AND METHOD OF USE

FIELD OF INVENTION

The present invention relates to cluster valves and multi-stage liners used in directional, including but not limited to horizontal oil and gas wells, either in open hole or cased completions to permit isolation between multiple hydrocarbon zones and to perform multiple fractures in the hydrocarbon zones.

BACKGROUND OF THE INVENTION AND DESCRIPTION OF PRIOR ART

This background information and publications mentioned below are provided for the purpose of making known information believed by the applicant to be of possible relevance to the present invention, and in particular allowing the reader to understand advantages of the invention over devices and methods known to the inventor, but not necessarily public, devices and methods. No admission is necessarily intended, nor should be construed as admitting, that any of the following documents constitute legally citable prior art against the present invention.

After oil and gas wells are drilled, the oil and gas reservoirs or zones of interest need to be completed, namely conditioned by typically a fracking operation, in order to best and most quickly produce oil and gas flow from each particular zone. If the zone of interest requires a type of fracture stimulation, including but not limited to acid fracture or propped fracture, the zone of interest will be isolated to focus the fracture on the zone and to prevent fracture in other zones, which may not be desired. Liner systems can be used prior to conducting the fracture stimulation and can be run in either open hole or cased hole applications.

In the stimulation of directional and horizontal wells, it can be desirable to treat multiple stages in a single zone, known as a cluster, with a single fracture stimulation. It can also be desirable to treat more than one zone with a single fracture stimulation to save time and expense associated with multiple treatments and time spent running tubing and tools in and out of the wellbore.

Various downhole tools have been used to stimulate wells including to treat them in multiple stages, but many of these tools require components within the bore of the liner at each valve which may disadvantageously thereby restrict flow of fluid through the liner during fracture pumping operations, and potentially the further need to mill out such components at each valve location prior to switching to production flow from the hydrocarbon bearing zones. Due to such flow restrictions, pressure drops occur, which result in less efficient operations as there is pressure loss incurred prior to the fracture fluid contacting the zone. Ideally, less pressure drop is desired to conduct a fracture stimulation more efficiently in each stage and in addition. Moreover, it is desirous to have fewer materials/components to mill out within the bore liner immediately prior to commencing production from the hydrocarbon bearing zones.

In this regard, for example, U.S. Pat. No. 8,215,411 teaches cluster opening sleeves for wellbore treatment and utilizes a ball member or plug to open a sleeve at each valve, thereby allowing fluid communication between the bore and a port in the sleeve's housing. This invention requires, however, a ball seat corresponding to each sleeve in a cluster valve, potentially restricting flow. The presence of a ball seat at each valve to be opened, due to the resulting bore restriction at each valve sleeve, creates a significant pressure drop across the cluster valve assembly.

U.S. Pat. No. 8,395,879 teaches a hydrostatically powered fracturing sliding sleeve. Again, such configuration utilizes a single ball, but each sleeve configuration requires its own ball seat.

U.S. Pat. No. 4,893,678 discloses a multiple-set downhole tool and method that utilizes a single ball. Again, each valve requires a seat.

Lastly, US Patent Application Publication No. 2014/0102709 discloses a tool and method for fracturing a wellbore that uses a single ball, each valve with a deformable ball seat. Again, each valve has a valve seat which remains with each valve.

SUMMARY OF THE INVENTION

It is an object of the invention to provide an improved multi-stage liner with cluster valves and method of us thereof.

In accordance with a first aspect, the invention provides a cluster valve assembly for successively opening a plurality of radial ports axially spaced along a liner situated within a wellbore, comprising:

- a tubular liner defining a bore;
- a ball member;
- a ball seat, having an axial passage therein of lesser size than said ball member;
- a plurality of slidably moveable valve sleeves, located within said liner, each valve sleeve disposed within the bore and axially moveable relative to the liner along said bore from a first uphole position obstructing one or more ports in said tubular liner to a second downhole position in which said one or more ports are open;
- a corresponding plurality of collet sleeves each coupled to or integral with a corresponding valve sleeve and slidably moveable within said bore, each collet having one or more protuberances radially moveable from a first inward position where said protuberances engageably couple said collet to said ball seat when said valve sleeve and collet sleeve are in said first uphole position, to a radially outward second position disengaged from said ball seat when said valve sleeve and collet sleeve is slidably moved by said ball seat to said second downhole position wherein said ball seat becomes disengaged from said collet sleeve and protuberances thereof and said ball seat is thereby allowed to thereafter move further downhole;
- said ball seat initially engaging a most uphole first collet and corresponding first valve sleeve;

wherein said ball and ball seat when exposed to uphole fluid pressure, together move downhole in said liner and engage said first collet sleeve and move said corresponding first valve sleeve downhole to said second downhole position to thereby open said one or more ports in said liner previously obstructed by said first valve sleeve and said ball seat thereafter becomes released from engagement with said first collet sleeve and thereafter with said ball member moves further downhole to engage a second collet sleeve and corresponding second valve sleeve and thereafter again move together as a unit to cause said second valve sleeve to move downhole to said second downhole position to open additional ports in said liner previously obstructed by said second valve sleeve.

In a preferred embodiment of the above cluster valve assembly, such further comprises:

a ball seat stop located within said liner and downhole from said plurality of valve sleeves, which ball seat stop member is prevented from rotation in at least one direction in said liner;

said ball seat comprising a surface on the downhole end thereof that interleaves with a corresponding surface on said ball seat stop;

wherein when said ball and ball seat move downhole and come into contact with said ball seat stop and said surface on said ball seat interleaves with said surface on said ball seat stop, rotation in said at least one direction and further axial movement downhole of said ball seat is thereafter prevented.

In a further preferred embodiment, such cluster valve assembly further comprises:

a plurality of burst plates disposed across or within each port, said burst plates remaining in a closed position and thereby maintaining pressure within the bore while said valve sleeves move downhole, and said burst plates opening at a threshold fluid pressure level within the bore after said ball and ball seat move into contact with said ball seat stop.

In another aspect of the present invention, the invention comprises a downhole tool assembly comprising first and second cluster valve assemblies as defined above, axially positioned along said liner, wherein said first cluster valve assembly is positioned uphole from said second cluster valve assembly; and wherein said ball seat in said first cluster valve assembly has a diameter greater than a diameter of said ball seat in said second cluster valve assembly.

In a further aspect of the present invention, such invention comprises a method of using the cluster valve assembly as above described, comprising:

dropping said ball member within said bore and flowing said ball member downhole via fluid pressure within said bore;

causing said ball member to engage said ball seat;

causing said ball member and ball seat, under fluid pressure to move downhole and slidably move at least two valve sleeves from said first position to said second position.

Lastly, in a narrow refinement of the invention, such invention comprises a method of using a cluster valve assembly for successively opening a plurality of radial ports axially spaced along a liner situated within a wellbore, comprising:

circulating cement downhole through the bore and returning uphole via the annulus between the liner and the wellbore;

dropping a wiper ball down the liner and pumping it through the liner to clean residual cement by pushing it downhole ahead of the wiper ball;

landing the wiper ball in a landing collar at the distal end of the liner; said cluster valve assembly comprising:

a tubular liner defining a bore;

a ball member;

a ball seat, having an axial passage therein of lesser size than said ball member;

a plurality of slidably moveable valve sleeves, located within said liner, each valve sleeve disposed within the bore and axially moveable relative to the liner along said bore from a first uphole position obstructing one or more ports in said tubular liner to a second downhole position in which said one or more ports are open;

a corresponding plurality of collets each coupled to or integral with a corresponding valve sleeve and slidably moveable within said bore, each collet having one or more protuberances radially moveable from a first inward position where said protuberances engageably couple said collet to said ball seat when said valve sleeve and collet are in said first uphole position, to a radially outward second position disengaged from said ball seat when said valve sleeve and collet is slidably moved by said ball seat to said second downhole position wherein said ball seat becomes disengaged from said collet and protuberances thereof and said ball seat is thereby allowed to thereafter move further downhole;

said ball seat initially engaging a most uphole first collet and corresponding first valve sleeve; and wherein said ball and ball seat when exposed to uphole fluid pressure, together move downhole in said liner and engage said first collet and move said corresponding first valve sleeve downhole to said second downhole position to thereby open said one or more ports in said liner previously obstructed by said first valve sleeve and said ball seat thereafter becomes released from engagement with said first collet and thereafter with said ball member moves further downhole to engage a second collet and corresponding second valve sleeve and thereafter again move together as a unit to cause said second valve sleeve to move downhole to said second downhole position to open additional ports in said liner previously obstructed by said second valve sleeve.

This above summary of the invention does not necessarily describe all features of the invention.

For a complete description of the invention, reference is to further be had to the drawings and the detailed description of preferred embodiments.

BRIEF DESCRIPTION OF THE DRAWINGS

The above and other features of the invention will become more apparent from the following description in which reference is made to the appended figures wherein:

FIGS. 4-7 show successive operation of a ball seat and ball member on a first go valve within a cluster valve grouping of the present invention, wherein:

FIG. 4 shows a single go valve for use within a cluster valve grouping of the present invention, wherein a ball member [which can be a plug, dart, or the like but in the embodiments shown is a ball 48] has contacted a ball seat and such ball and ball seat are together moving downhole in the direction of the first go valve within a first cluster valve grouping of the present invention;

FIG. 5 shows the ball and ball seat having together moved further downhole wherein the ball seat has become engaged by collet fingers within the first go valve forming part of the cluster valve assembly;

FIG. 6 shows the ball and ball seat having moved the valve sleeve in the first go valve to an open position to thereby uncover ports in the liner, and the collet fingers within the first go valve have become disengaged from the ball seat;

FIG. 7 shows the ball and ball seat after having become disengaged from the collet fingers and moved further downhole, travelling towards the next go valve or stop valve in a first cluster valve grouping;

FIGS. 8-9 show successive operation of a ball seat and ball member on a stop valve within a cluster valve grouping of the present invention, wherein:

FIG. 8 shows the stop valve within such cluster valve grouping, wherein the ball and ball seat are together moving downhole in the direction of the arrows shown and are approaching the stop valve within such cluster valve grouping;

FIG. 9 shows the stop valve within such cluster valve grouping, wherein the ball and ball seat member have moved further downhole and moved the valve sleeve in the stop valve downhole to thereby expose the ports in the liner, and after the ball and ball seat have moved further downhole and contacted and become engaged with the anti-rotation member;

FIG. 10(*b*) is a left side view of the intermediate member of FIG. 10(*a*);

FIG. 10(*c*) is a right side view of the intermediate member of FIG. 10(*a*);

FIG. 10(*d*) is a view of the interleaving surface of the intermediate member 46 of FIG. 10(*a*);

FIG. 11(*b*) is a partial left-hand (uphole) side view of the seat member of FIG. 11(*a*); and FIG. 11(*c*) is a partial right-hand (downhole) side view of the seat member of FIG. 11(*a*).

DETAILED DESCRIPTION OF SOME PREFERRED EMBODIMENTS OF THE INVENTION

Figure 1:
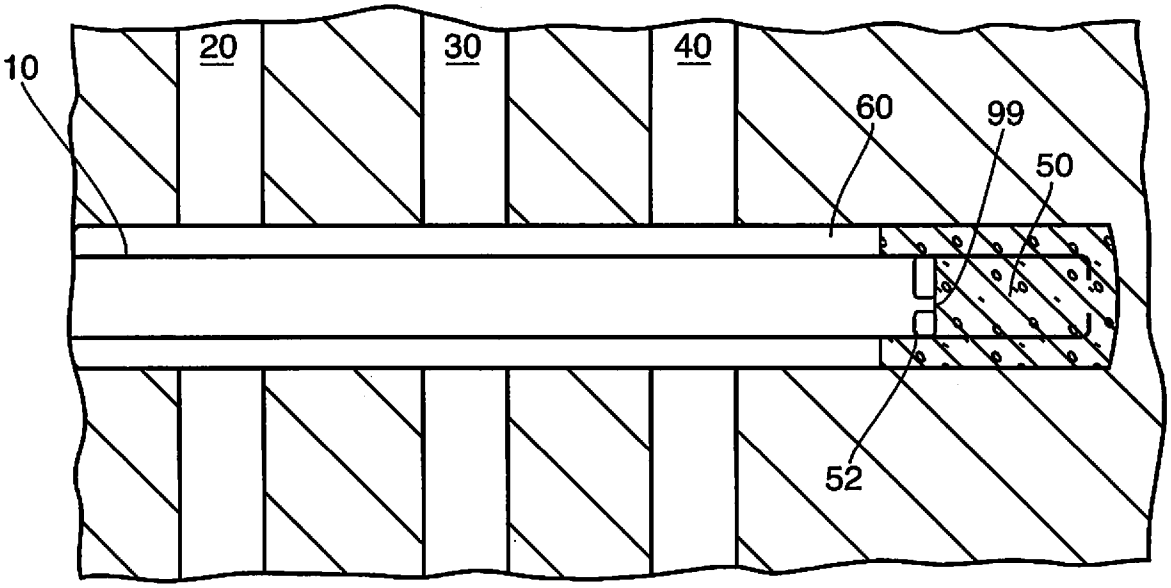
FIG. 1 shows a horizontal wellbore with hydrocarbon zones intended to be fracture stimulated.

Similar components in various figures are identified with similar reference numerals.

The cluster valve multi-stage liner 10 of the present invention, comprising at least one go valve 11 (and preferably and advantageously a plurality of go valves 11) and a single stop valve 13, can preferably be used in any oil and gas well after drilling. The liner 10 may also be used in other types of producing or injection wells.

A typical configuration in a drilled well, whether it is partly cased or open hole, appears in FIG. 1. Liner 10 as been lowered on tubing from a service or drilling rig on surface, and inserted into the drilled well and positioned therein at a location therein, typically where the wellbore in a deviated well is horizontal, as shown. The liner 10 is used to isolate hydrocarbon zones 20, 30, 40 during fracture stimulations of a hydrocarbon formation in the region of said zones 20, 30, 40.

In FIG. 1, various hydrocarbon zones of interest are shown by reference numerals 20, 30 and 40. The liner 10 may be manufactured for various strengths and lengths before insertion into the wellbore, but typically the liner 10 comprises multiple lengths joined together at threaded ends. The liner 10 is inserted or run into the wellbore, typically on tubing suspended by a service rig on surface, and placed at the desired length along the wellbore to fracture stimulate the zones to enhance production into the wellbore. One or more cluster valve assemblies of the present invention, each comprising one or more go valves 11 (ref FIG. 2) and an associated stop valve 13 (ref. FIG. 3) of the present invention are located along the wellbore, at respective hydrocarbon zones 20, 30, 40, for simultaneous actuation of all valves within each hydrocarbon zone for fracking or cement injection within each zone, with a cluster valve grouping in a given hydrocarbon zone 20 being independently acutable from a cluster valve grouping in another hydrocarbon zone 30, 40 situated uphole or downhole from such given zone 20.

Figure 2:
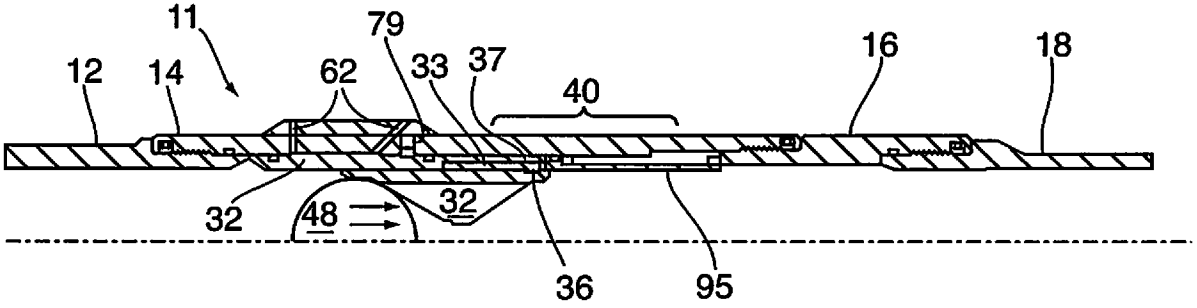
FIG. 2 shows, in lateral cross-section a liner of the present invention, a single go valve, namely one embodiment thereof, for use within a cluster valve grouping and multi-stage liner of the present invention, with uphole shown in the left of FIG. 2 and downhole shown on the right side of FIG. 2, when the ball and ball seat upon fluid pressure being provided from uphole, are imminently about to cause the go valve sleeve to move downhole in the direction of the arrow shown to thereby expose valve ports within the first go valve.
Figure 3:
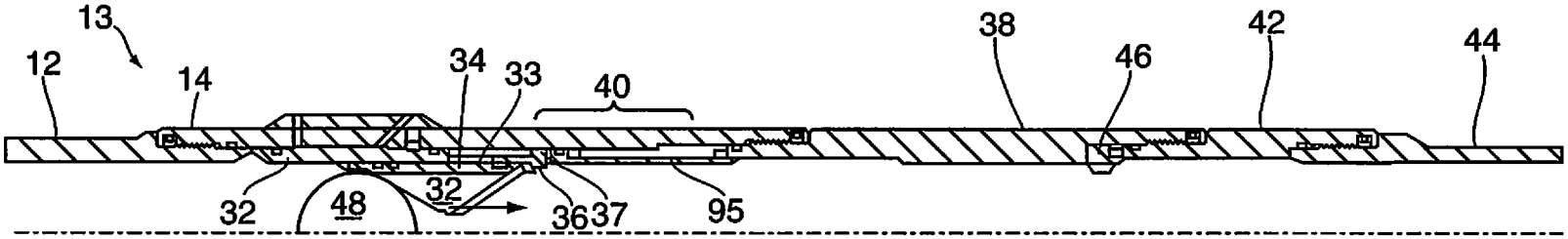
FIG. 3 shows in lateral cross-section a liner of the present invention, in particular a single stop valve and non-rotation member for use within a cluster valve grouping of the present invention, with uphole shown in the left and downhole shown on the right of FIG. 3, when the ball and ball seat are imminently about to cause the stop valve sleeve to move downhole in the direction of the arrow shown, to thereby expose valve ports within the stop valve and liner.

FIG. 2 shows one embodiment of a go valve 11 of the present invention in cross-section, which go valve 11 forms part of a cluster valve assembly within a liner 10. Cluster interval go valve 11 comprises a top sub 12, a housing 14 having a number of ports 62 therein to allow egress of fluid from within the bore of liner 10 into a respective fracture zone 20, 30, or 40 (as the case may be), a crossover 16, and a bottom sub 18, all of which are tubular shaped members threaded together in that order in the direction of moving downhole. Forming part of each valve 11, 13 in a cluster valve assembly of the present invention is a slidable sleeve 32, which is preferentially initially secured in a position covering ports 62 via one or more shear screws 79 within liner 10 which initially retain slidable valve sleeve 32 in a position covering ports 62. Each valve sleeve 32 typically is provided with one or more extended seals 68 disposed on the proximal end of the exterior of each sleeve 32, as shown on FIGS. 4 and 8, which permit uninterrupted travel by each sleeve 32 along the bore of said liner 10 between the first (closed) and second (open) positions.

FIG. 3 shows a cluster interval stop valve 13 for use in a cluster valve grouping within a liner of the present invention, comprising a top sub 12, housing 14, a stop sub 38, crossover 42 and bottom sub 44, threaded together in that order. In addition such cluster interval stop valve 13 comprises a ball seat stop 46, which is a tubular shaped member disposed within the bore of stop sub 16. Ball seat stop 46 is described below, and is further shown in enlarged detail in FIGS. 10(*a*)-(*c*).

Figure 11C:
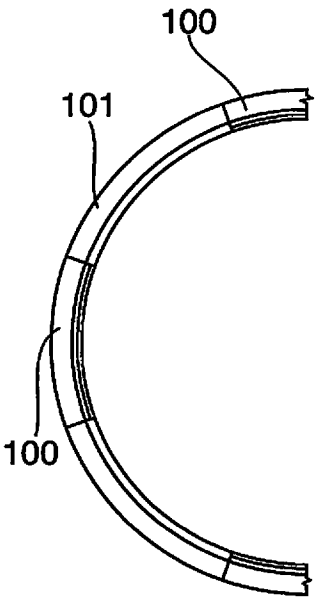
FIG. 11(*a*) is a cross-sectional view of one embodiment of the ball seat member of the present invention, having on at least a downhole side thereof interleaving means to interleave with the intermediate member of FIG. 11(*a*)
Figure 11A:
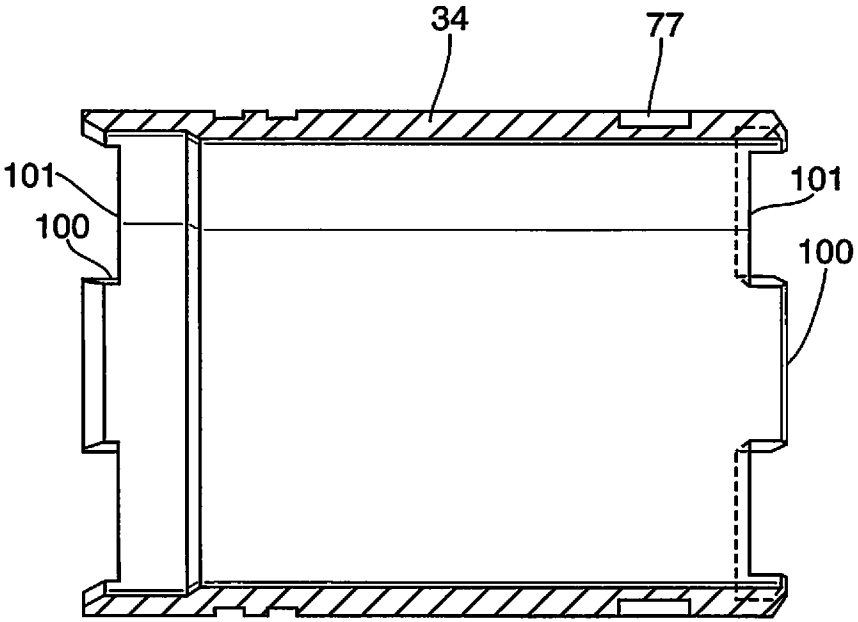
Figure 11B:
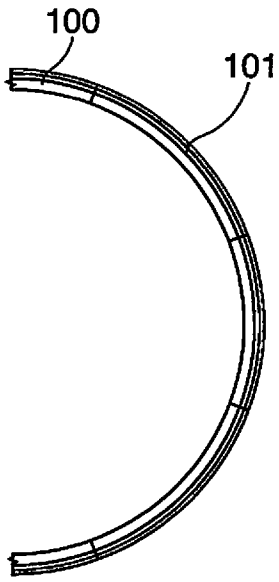

In all FIGS. 2-9 there is shown a valve sleeve 32, ball seat 34 and valve sleeve stop and "seat disengaging" assembly 40. Assembly 40 comprises a collet sleeve 33, having flexible radially outwardly-extending protuberances (ie "fingers") 37 and radially inwardly extending 36, a sliding stop sleeve 95, and a radial indenture 57 within housing 14 to receive radially upwardly-extending protuberances 37 of collet sleeve 33. Downwardly protruding collet fingers 36 are adapted to engage a radial groove 77 (ref. FIG. 11(*a*) on ball seat 34.

Alternative Configurations of Assembly 40

Figures 4, 5, 6, 7:
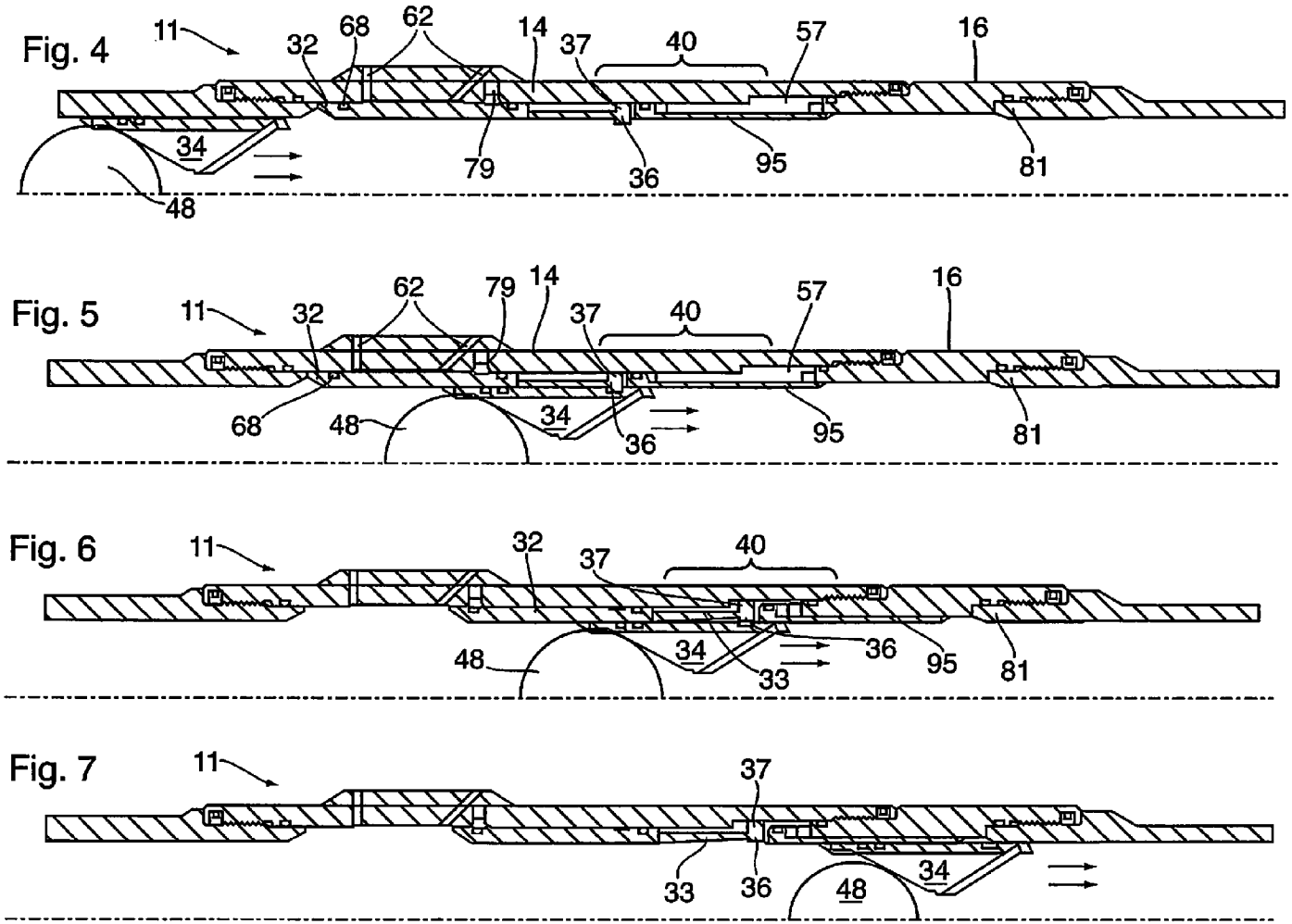
Figure 8:
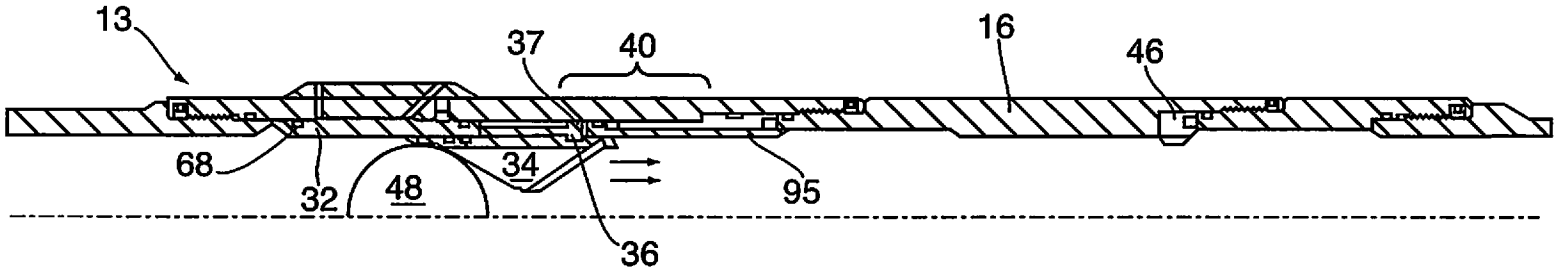
Figure 9:
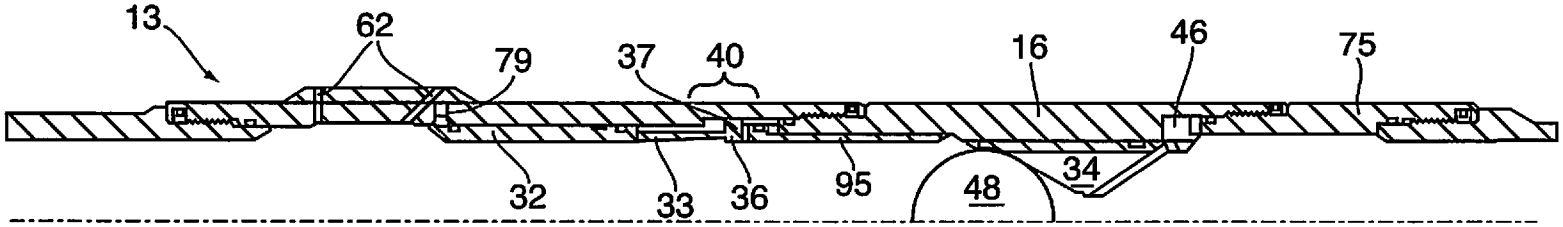

Seat disengaging assembly 40, which includes collet fingers 36,37, in all embodiments thereof allows ball seat 34 to become temporarily engaged or coupled with sleeve 32 to allow repositioning of sleeve 32 from a first closed uphole position obstructing ports 62 to a second downhole open position not obstructing ports 62, is shown in FIGS. 2, 5 & 7 respectively with respect to go valve 11, and in FIGS. 8 & 9, respectively with respect to stop valve 13. Upon movement of the ball seat 34, valve sleeve 32, and collet sleeve 33 from the first uphole position to the second downhole position, the seat disengaging assembly 40 allows the ball seat 34 to become disengaged from the collet sleeve 33 and valve sleeve 32, to thereby permit the ball seat 34 to further travel downhole for further actuation of additional go valves 11, if desired, and to ultimately actuate and engage a downhole stop valve 13, in the manner described below.

In a first embodiment of assembly 40 shown in FIG. 2, the downhole side edge of ball seat 34 when moving downhole merely comes into contact with the radially inwardly protruding protuberances ("fingers") 36 of collet sleeve 33, the latter being coupled to valve sleeve 32. Fluid pressure applied uphole causes the ball seat 34, valve sleeve 32, and collet sleeve 33 to together slidably move downhole, thereby removing valve sleeve 32 from covering ports 62. Protuberances 37 on collet sleeve 33 thereafter effectively lock valve sleeve 32 in the open position in which ports 62 are uncovered, and prevent further downhole or uphole motion of valve sleeve 32.

In another embodiment of the seat disengaging assembly 40, as shown in FIGS. 4-6 and as more fully described below, the radially inwardly protruding protuberances ("fingers") 36 of collet sleeve 33 initially engage a radial groove 77 in ball seat 34 to thereby couple ball seat 34 to collet sleeve when the valve sleeve 32 and collet sleeve 33 are in the first uphole position. Thereafter, when ball seat 34, valve sleeve 32 and associated collet sleeve 33 are together forceably slid downhole due to uphole fluid pressure causing ports 62 to be opened, protuberances/fingers 37 on collet sleeve 33 move into indenture/indentation 57, causing collet fingers 36 to disengage radial groove 77. In that second position, the ball seat 34 thereby becomes disengaged from the collet sleeve 33 and the collet protuberances 36, and the ball seat 34 is then allowed to then move further downhole. Again, protuberances 37 on collet sleeve 33 effectively lock valve sleeve in the open position and prevent further downhole or uphole motion of valve sleeve 32.

Various other alternative configurations and arrangements for assembly 40, comprising valve sleeve 32, collet sleeve 33, indenture 57, and collet fingers 36, 37 to accomplish the above desired capabilities will now occur to those skilled of skill in tool design.

Configuration of go Valves and Stop Valve within Liner According to Invention

FIGS. 4-7 show, in sequence, the cluster interval go valve 11 when a ball member 48 as defined herein passes along the bore of the liner 10 into abutting engagement with ball seat 34. Ball seat 34 has an axial passage therein that is a lesser size than the ball member 48. The ball seat 34 has at least one means, such as a face thereof or a radial groove 77 therein, for engaging, for a limited time, a radially downwardly extending protuberance 36 on collet sleeve 33, as shown in FIGS. 2 & 5, and FIG. 8, which ball seat 32 becomes disengaged from such protuberance 36 upon ball seat 34 moving downhole, as shown in FIGS. 6 & 9. Valve sleeve 32 is disposed within the bore of the liner 10 and is longitudinally slidably moveable downhole within the liner 10 as ball member 48 is pushed against the ball seat 34 by fluid pumped downhole from the surface. Each valve sleeve 32 within a single cluster valve assembly is axially moveable relative to the liner 10 along the bore from a first uphole position, where it obstructs one or more ports 62 in the liner 10, as shown in FIGS. 2-5 & 8, to a second downhole position where the ports 62 are not obstructed, as shown in FIGS. 6 & 9. Ball seat 34 has an axial passage therein of lesser size than the ball member 48, resulting in pressure being temporarily contained in the fluid above ball member 48 once ball member 48 has become seated in ball seat 34.

In a preferred embodiment, burst plates (not shown) may be disposed across or within each of the ports 62. Burst plates allow fluid communication from the bore of the liner 10 to the exterior of the liner 10 when the pressure in the bore 10 is increased to a pre-determined threshold level. Once the pressure reaches this level, the burst plate(s) will rupture, thereby allowing fluid communication between the two areas that were previously on opposite sides of the burst plate. The burst plates remain in a closed position and thereby maintain pressure within the bore while the valve sleeves 32 move axially downhole. Once the threshold fluid pressure level within the bore reaches the predetermined threshold level, after the ball member 48 and ball seat 34 have contacted the ball seat stop 46, the burst plates will rupture and allow the stimulation fluid to flow at high pressure from the bore of the liner 10 through the ports 62 to the formation, thereby conducting the fracture stimulation. In a preferred embodiment, the burst plates may be erodable burst plates, having one or a few needle-like holes in them to assist in creating backpressure in the liner 10 to burst plates covering ports 62 and thereby open ports 62. However, if some ports 62 do not burst for whatever reason, continued flow of fluid through the needle-like holes in such erodible burst plates will eventually erode the burst plates as the fracturing operation continues, to thereby ensure the ports 62 become opened.

As shown in FIGS. 2-9 for each valve sleeves 32 in a single cluster valve assembly 11, 13 there are a corresponding plurality of collet sleeves 33, each coupled to or integral with a corresponding valve sleeve 32 and slidably moveable within the bore of liner 10. Each collet sleeve 33 has one or more radial upward protuberances 37 and one or more corresponding downward protuberances 36 that are radially moveable from a first inward position, as shown in FIG. 5,8, to a second radially outwardly extended position, as shown in FIG. 6,9. In the first position, the protuberances 36 of collet sleeve 33 engageably couple radial groove 77 in ball seat 34 to couple ball seat 34 to collet sleeve when the valve sleeve 32 and collet sleeve 33 are in the first uphole position. Thereafter, when ball seat 34, valve sleeve 32 and associated collet sleeve 33 are together forceably slid downhole due to uphole fluid pressure causing ports 62 to be opened, protuberances/fingers 37 move into indenture/indentation 57, and collet fingers 36 disengage from ball seat 34. In that second position, the ball seat 34 thereby becomes disengaged from the collet sleeve 33 and the collet protuberances 36, and the ball seat 34 is allowed to then move further downhole.

FIGS. 8 & 9 show the most downhole cluster valve in a cluster valve assembly, namely the cluster valve stop valve 13, which is provided with a ball seat stop 46 disposed within the stop sub 16. FIG. 8 shows a cluster stop valve 13 before the ball seat 34 contacts ball seat stop 46. FIG. 9 shows a cluster stop valve 13 after the ball seat 34 contacts ball seat stop 46.

Figures 10A, 10B, 10C, 10D:
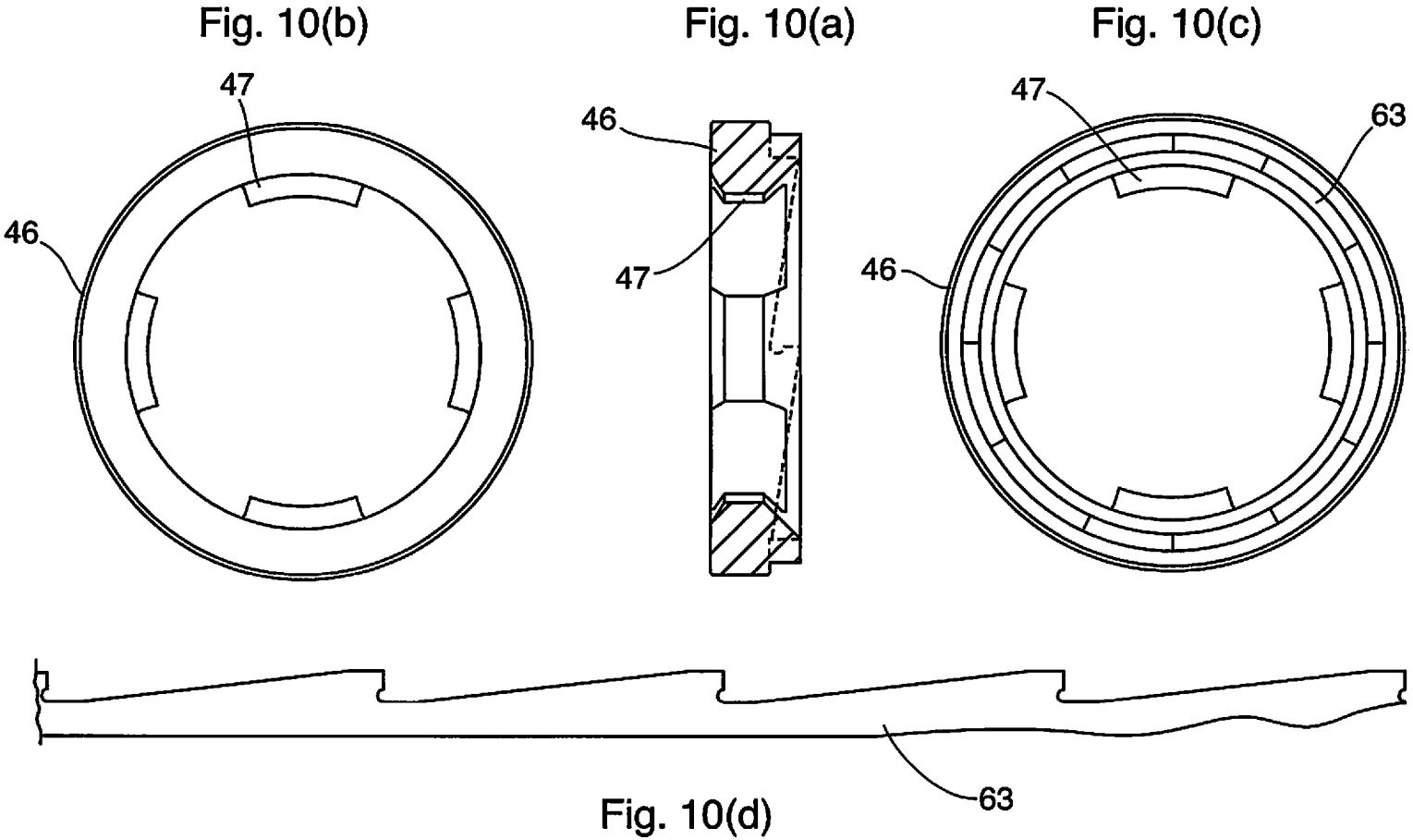
FIG. 10(*a*) shows a cross sectional view one embodiment of the anti-rotation means/member of the present invention to better facilitate reaming out the ball and seat at the stop valve in a cluster valve, further comprising an intermediate member having anti-rotation means thereon.

In a preferred embodiment, as best shown in FIGS. 10(*a*)-(*c*), such ball seat stop 46 further possesses means to prevent rotation of the ball seat 34 in at least one direction when such ball seat 34 contacts ball seat stop 46, as shown in FIG. 9, to assist a rotary reamer (not shown) in drilling out such ball seat 46 and ball member 48 after fracturing and when production from the wellbore is desired to be commenced.

In one preferred refinement of such embodiment, ball seat stop 46 comprises an annular ring having a series of clutch fingers 47 on an uphole side thereof, which interleave with corresponding protrusions 100 and indentations 101 on a downhole side of ball seat 34 (in the embodiment shown in FIG. 10(*a*)-(*c*), ball seat 34 can be inserted in liner 10 in either direction). Similarly, corrugated interleaving surface 63 (ref FIGS. 10(*c*) and (*d*)) on annular ring 46 on a downhole side edge thereof interleaves with a corresponding corrugated surface (not shown) provided on sub 75 (ref FIG. 9), which when such two members are in contact and engaged, prevents rotation of ball seat 34 in at least one direction within liner 10, to more easily permit a rotary reamer or mill to drill out such ball 48 and ball seat 34 immediately prior to commencing production.

Operation of Cluster Valve Grouping within Liner for Conducting a Fracking Operation In use, as shown in FIG. 1, the liner 10 of the present invention, having one or more cluster valve series, is run downhole, typically in a directional or horizontal completion, to the desired depth. A wiper ball landing collar 52 of the type known in the art is placed at the distal end of the string, along with a port 99 that will be open while the string is run downhole and which will become closed upon receiving the wiper ball in the collar (as further described, below). Such port 99 and wiper ball landing collar 52 are known in the art.

Specifically, once the fracking/production string with the liner 10 is in placed within the wellbore, in a preferred embodiment cement 50 is pumped down through the tubing string, and continues down through the liner 10 and circulates around the annulus 60 between the outside of the liner 10 and the inside of the cased or open hole, as shown partially completed in FIG. 1.

Once the desired volume of cement is pumped into the tubing sealing the liner 10 within the wellbore, a first wiper plug or ball 70 (not shown-hereinafter referred to as a wiper ball, but various types of such plugs are known in the art) is inserted at surface into the tubing string, and forced downhole by uphole application of a completion fluid or fracking fluid. The wiper ball 70 travels to the end of the string, wiping it of excess cement, and closes port 99. The wiper ball 70 is pumped down the tubing and liner 10 until it is restrained at the wiper ball landing collar 52.

When the wiper ball passes through the cluster interval go valves 12, the wiper ball collapses through the valves 11, 13 and expands thereafter to clean residual cement from the liner 10. Once the wiper ball 70 reaches the wiper ball landing collar 52, it actuates a sleeve in landing collar 52 to shift the sleeve to a closed position in a known manner, to thereby close port 99 thereby isolating the fluid in the bore of the liner from the annulus 60.

Thereafter, the above procedures then allow for the cluster valve series of the present invention to be operated in the desired inventive manner. In particular, to initiate the fracture, a ball member 48 is then inserted at surface into the tubing string, and pumped downhole via the uphole fluid pressure. The ball member 48 will descend in the tubing until it reaches the ball seat 34, as shown in FIGS. 4 and 5. Once the ball contacts the ball seat 34, the ball member 48 and ball seat 34 act as a piston and slide downhole together toward the next go valve 11. After travelling a pre-determine length of travel, the valve sleeve 32, collet sleeve 33, and sliding sleeve 95 which travel together from a first position to a second position, will be restrained by as the protuberances 37 of collet sleeve 33 engaging radial indenture 57 between the housing 14 and crossover 16. As the first go valve sleeve 32 in a cluster valve grouping typically comprising a plurality of go valves 11 moves to the second position, the ports 62 in the liner 10, which were previously obstructed by the valve sleeve 32, become unobstructed once the valve sleeve 32 moves to the second position. The sliding sleeve 95 will abut against sub 16, and as a result, valve sleeve 32 is prevented from any further downhole travel. The ball seat 34 then becomes released from engagement with the first collet sleeve 33, and ball member 48 is thereby permitted to move further downhole to engage a second collet sleeve 33 and corresponding second valve sleeve 32 in a second go valve, which will again move together as a unit to cause the second valve sleeve 32 to move downhole to a second downhole position to open additional ports 62 in the liner 10 which were previously obstructed by a second valve sleeve 32.

This foregoing sequential activation by ball member 48 and ball seats 34 sliding together as a piston repeats until all cluster go valves 11 within a series are opened and until the stop valve 13 is reached by ball seat 34.

The ball member 48 and ball seat 34 will continue travel as one piston to the stop valve 13, which is the most downhole valve in a given cluster valve grouping, as shown in FIGS. 8&9. At the cluster interval stop valve 13, the ball member 48 and ball seat 34 move downhole and come into contact with the ball seat stop 46, and protrusions 100 and indentations 101 on a downhole side of ball seat 34 interleave with the clutch fingers 64 on the ball seat stop 46. Once they have interleaved in this manner, the ball seat 34 is prevented from further rotation and axial movement downhole.

Once all cluster valves are shifted open, the area of the zone across outside each open valve in a cluster can be fractured at the same time.

If desired, multiple zones 20, 30, 40 can be fractured by positioning a cluster valve grouping, comprising one or more go valves 11 and a stop valve 13, in each zone. Each zone will have a cluster stop valve 13 at the distal end of each zone 10, 20, 30, and above the cluster stop valve 13 will be the sequence of multiple cluster go valves 11. Each zone 10, 20, 30 on will comprise a plurality of cluster go valves 11, but with a respective ball seat 34 of increased diameter for each go valve 11 in the uphole direction. The seat diameter for each ball seat 34 increases sequentially in each stage (progressing uphole) to allow for opening the valve sleeves 32 in each stage by ball members 48 of different diameters. Cluster go valves 11 with the smallest diameter for ball seats 34 would be placed in the distal stage, and cluster go valves 12 with the largest diameter for ball seats 34 would be placed in the proximal stage.

Advantageously, this placement of various stages of go valves 11 allows a fracking operator to sequentially fracture multiple zones within a formation, in a sequence from the zone that is furthest along the wellbore from the surface to the zone that is closest to the surface with a single placement of the tubing string in the wellbore. Once the distal cluster stage is fractured, a ball member 48 that is incrementally larger can be dropped and the process is repeated to fracture the next higher zone.

Once the fracture stimulations are completed, each ball seat 34, ball member 48 and associated valve sleeve 32 of each stop valve 13 will be restrained axially and rotationally in ball seat stop 34 for each stage.

Since ball seat 34 is restrained from rotating against the ball seat stop 34, a milling tool or reamer can be run downhole to rotate against the ball member 48, ball seat 34 and ball seat stop 46, allowing quick and ready milling to clear the bore, resulting in reduced time and cost compared to other arrangements of cluster valves that require more than one ball member and ball seat per stage of cluster valves, and further may not be provided with an anti-rotation means which thereby slows or renders ineffective the rotary reaming operation.

Advantageously, this cluster valve multi-stage liner of the present invention only requires one ball seat per stage, resulting in fewer restrictions in the liner bore during fracture stimulations. As a result, there is less pressure drop within the liner while pumping the fracture fluid, thereby making the fracture operation more efficient. With fewer restrictions in the liner bore, millout operations are also quicker and less complicated resulting in saved time and expense when switching from fracturing the zones to producing flow back from the zones.

What is claimed is:

1. A cluster valve assembly for successively opening a plurality of radial ports axially spaced along a liner situated within a wellbore, comprising:

a tubular liner defining a bore;

a ball member;

a ball seat, having an axial passage therein of lesser size than said ball member;

a plurality of slidably moveable valve sleeves, located within said liner, each valve sleeve disposed within the bore and axially moveable relative to the liner along said bore from a first uphole position obstructing one or more ports in said tubular liner to a second downhole position in which said one or more ports are open;

a corresponding plurality of collet sleeves each coupled to or integral with a corresponding valve sleeve and slidably moveable within said bore, each collet sleeve having one or more protuberances radially moveable from a first inward position where said protuberances engageably couple said collet to said ball seat when said valve sleeve and collet sleeve are in said first uphole position, to a radially outward second position disengaged from said ball seat when said valve sleeve and collet sleeve are slidably moved by said ball seat to said second downhole position wherein said ball seat becomes disengaged from said collet sleeve and protuberances thereof and said ball seat is thereby allowed to thereafter move further downhole;

said ball seat initially engaging a most uphole first collet and corresponding first valve sleeve;

wherein said ball and ball seat when exposed to uphole fluid pressure, together move downhole in said liner and engage said first collet sleeve and move said corresponding first valve sleeve downhole to said second downhole position to thereby open said one or more ports in said liner previously obstructed by said first valve sleeve and said ball seat thereafter becomes released from engagement with said first collet sleeve and thereafter with said ball member moves further downhole to engage a second collet sleeve and corresponding second valve sleeve and thereafter again move together as a unit to cause said second valve sleeve to move downhole to said second downhole position to open additional ports in said liner previously obstructed by said second valve sleeve.

2. The cluster valve assembly of claim 1, further comprising:

a ball seat stop located within said liner and downhole from said plurality of valve sleeves, which ball seat stop member is prevented from rotation in at least one direction in said liner;

said ball seat comprising a surface on the downhole end thereof that interleaves with a corresponding surface on said ball seat stop;

wherein when said ball and ball seat move downhole and come into contact with said ball seat stop and said surface on said ball seat interleaves with said surface on said ball seat stop, rotation in said at least one direction and further axial movement downhole of said ball seat is thereafter prevented.

3. The cluster valve assembly of claim 2, further comprising:

a plurality of burst plates disposed across or within each port, said burst plates remaining in a closed position and thereby maintaining pressure within the bore while said valve sleeves move downhole, and said burst plates opening at a threshold fluid pressure level within the bore after said ball and ball seat move into contact with said ball seat stop.

4. The cluster valve assembly of claim 3, further comprising:

seals disposed on proximal and distal ends of an exterior of each sleeve, thereby permitting uninterrupted travel by each sleeve along the bore of said liner.

5. The cluster valve assembly of claim 4, wherein:

same seals are disposed circumferentially about the exterior of each ball seat, thereby maintaining pressure within the bore of said liner while fluid pressure in the bore increases after said ball seat engages said ball seat stop.

6. A downhole tool assembly comprising first and second cluster valve assemblies as claimed in claim 2, axially positioned along said liner, wherein said first cluster valve assembly is positioned uphole from said second cluster valve assembly; and wherein said ball seat in said first cluster valve assembly has a diameter greater than a diameter of said ball seat in said second cluster valve assembly.

7. A method of using the downhole tool assembly of claim 6, wherein a first ball member used to actuate said collets and valve sleeves in said second cluster valve assembly is of a lesser diameter than a second ball member used to actuate said collets and valve sleeves in said first cluster valve assembly, wherein said method comprises:

dropping said first ball member within said bore and flowing said ball member downhole via fluid pressure within said bore;

causing said ball member to engage said ball seat in said second cluster valve assembly;

causing said first ball member and ball seat in said second cluster valve assembly to move downhole under fluid pressure and slidably move at least two valve sleeves from said first position to said second position;

dropping said second ball member within said bore and flowing said ball member downhole via fluid pressure within said bore;

causing said second ball member to engage said ball seat in said first cluster valve assembly; and causing said second ball member and ball seat in said first cluster valve assembly to move downhole under fluid pressure and slidably move at least two valve sleeves from said first position to said second position.

8. A method of using the cluster valve assembly of claim 2, comprising:

dropping said ball member within said bore and flowing said ball member downhole via fluid pressure within said bore;

causing said ball member to engage said ball seat;

causing said ball member and ball seat, under fluid pressure to move downhole and slidably move at least two valve sleeves from said first position to said second position.

9. A method of using the cluster valve assembly of claim 2, comprising:

dropping said ball member within said bore and flowing said ball member downhole via fluid pressure within said bore;

causing said ball member to engage said ball seat;

causing said ball member and ball seat, under fluid pressure to move downhole and slidably move all valve sleeves from said first position to said second position;

injecting a fracture stimulation fluid into the formation via the open ports in the liner; and thereafter inserting a rotary reamer in said liner and drilling out the ball member and ball seat when the ball member and the ball seat are in contact with said ball seat stop.

10. The cluster valve assembly as claimed in claim 1, further comprising:

a ball seat stop located within said liner and downhole from said plurality of valve sleeves, which ball seat stop member is prevented from rotation in said liner;

said ball seat comprising a surface on the downhole end thereof that interleaves with a corresponding surface on said ball seat stop; and wherein when said ball and ball seat move downhole and come into contact with said ball seat stop and said surface on said ball seat interleaves with said surface on said ball seat stop, both rotation of and further axial movement downhole of said ball seat is thereafter prevented.

11. A downhole tool assembly comprising first and second cluster valve assemblies as claimed in claim 1, axially positioned along said liner, wherein said first cluster valve assembly is positioned uphole from said second cluster valve assembly; and wherein said ball seat in said first cluster valve assembly has a diameter greater than a diameter of said ball seat in said second cluster valve assembly.

12. A method of using the downhole tool assembly of claim 11, wherein a first ball member used to actuate said collets and valve sleeves in said second cluster valve assembly is of a lesser diameter than a second ball member used to actuate said collets and valve sleeves in said first cluster valve assembly, wherein said method comprises:

dropping said first ball member within said bore and flowing said ball member downhole via fluid pressure within said bore;

causing said ball member to engage said ball seat in said second cluster valve assembly;

causing said first ball member and ball seat in said second cluster valve assembly to move downhole under fluid pressure and slidably move at least two valve sleeves from said first position to said second position;

dropping said second ball member within said bore and flowing said ball member downhole via fluid pressure within said bore;

causing said second ball member to engage said ball seat in said first cluster valve assembly; and causing said second ball member and ball seat in said first cluster valve assembly to move downhole under fluid pressure and slidably move at least two valve sleeves from said first position to said second position.

13. A method of using the cluster valve assembly of claim 1, comprising:

dropping said ball member within said bore and flowing said ball member downhole via fluid pressure within said bore;

causing said ball member to engage said ball seat;

causing said ball member and ball seat, under fluid pressure to move downhole and slidably move at least two valve sleeves from said first position to said second position.

14. A method of using the cluster valve assembly of claim 1, comprising:

dropping said ball member within said bore and flowing said ball member downhole via fluid pressure within said bore;

causing said ball member to engage said ball seat;

causing said ball member and ball seat, under fluid pressure to move downhole and slidably move all valve sleeves from said first position to said second position;

injecting a fracture stimulation fluid into the formation via the open ports in the liner; and thereafter inserting a rotary reamer in said liner and drilling out the ball member and ball seat when same are in contact with said ball seat stop.

15. A method of using a cluster valve assembly for successively opening a plurality of radial ports axially spaced along a liner situated within a wellbore, comprising:

circulating cement downhole through a bore and returning uphole via an annulus between the liner and the wellbore;

dropping a wiper ball down the liner and pumping it through the liner to clean residual cement by pushing it downhole ahead of the wiper ball;

landing the wiper ball in a landing collar at the distal end of the liner; said cluster valve assembly comprising:

a tubular liner defining a bore;

a ball member;

a ball seat, having an axial passage therein of lesser size than said ball member;

a plurality of slidably moveable valve sleeves, located within said liner, each valve sleeve disposed within the bore and axially moveable relative to the liner along said bore from a first uphole position obstructing one or more ports in said tubular liner to a second downhole position in which said one or more ports are open;

a corresponding plurality of collets each coupled to or integral with a corresponding valve sleeve and slidably moveable within said bore, each collet having one or more protuberances radially moveable from a first inward position where said protuberances engageably couple said collet to said ball seat when said valve sleeve and collet are in said first uphole position, to a radially outward second position disengaged from said ball seat when said valve sleeve and collet is slidably moved by said ball seat to said second downhole position wherein said ball seat becomes disengaged from said collet and protuberances thereof and said ball seat is thereby allowed to thereafter move further downhole;

said ball seat initially engaging a most uphole first collet and corresponding first valve sleeve; and wherein said ball and ball seat when exposed to uphole fluid pressure, together move downhole in said liner and engage said first collet and move said corresponding first valve sleeve downhole to said second downhole position to thereby open said one or more ports in said liner previously obstructed by said first valve sleeve and said ball seat thereafter becomes released from engagement with said first collet and thereafter with said ball member moves further downhole to engage a second collet and corresponding second valve sleeve and thereafter again move together as a unit to cause said second valve sleeve to move downhole to said second downhole position to open additional ports in said liner previously obstructed by said second valve sleeve.

* * * * *